United States Patent [19]

Osaki et al.

[11] Patent Number: 4,678,633

[45] Date of Patent: Jul. 7, 1987

[54] PROCESS FOR FORMING A SINTERED LAYER ON A SUBSTRATE OF IRON-BASED MATERIAL

[75] Inventors: Sigemi Osaki; Norio Yousina; Tsuyoshi Morishita, all of Hiroshima; Yasuhumi Kawado, Iwakuni, all of Japan

[73] Assignee: Mazda Motor Corporation, Hiroshima, Japan

[21] Appl. No.: 786,804

[22] Filed: Oct. 11, 1985

[30] Foreign Application Priority Data

Oct. 15, 1984 [JP] Japan ..... 59-215594
Oct. 15, 1984 [JP] Japan ..... 59-215595
Oct. 15, 1984 [JP] Japan ..... 59-215596

[51] Int. Cl.[4] ..... B22F 7/00

[52] U.S. Cl. ..... 419/8; 419/23; 419/36; 419/43; 419/47; 428/552; 428/562; 428/563

[58] Field of Search ..... 419/5–9, 419/47, 23, 36, 43; 428/552, 562, 563

[56] References Cited

U.S. PATENT DOCUMENTS 4,011,077 3/1977 Kaufman ..... 75/246
4,060,414 11/1977 Kaufman ..... 419/35
4,593,776 6/1986 Salesky et al. ..... 419/8

FOREIGN PATENT DOCUMENTS 52-65111 5/1977 Japan .

*Primary Examiner*—Stephen J. Lechert, Jr.
*Attorney, Agent, or Firm*—Fleit, Jacobson, Cohn & Price

[57] ABSTRACT

A process for forming a sintered layer on a substrate of an iron-based material containing carbon. A sheet of powders of an alloy is prepared by mixing the powders with a solution of resin and rolling the mixture into a sheet. The sheet is then heated to a sintering temperature. In order to prevent carbon content in the substrate from diffusing to the powder sheet during the sintering process, a lamina is provided beneath the powder sheet for example by a metal plating, a metal oxide layer, an intermediate alloy powder sheet, a decarbonized layer.

6 Claims, 5 Drawing Figures

(x 100)

(x 100)

(x 100)

PROCESS FOR FORMING A SINTERED LAYER ON A SUBSTRATE OF IRON-BASED MATERIAL

BACKGROUND OF THE INVENTION

1. Field of the Invention

The present invention relates to a sintering process, and more particularly to a process for providing a sintered layer on a substrate of an iron-based material. More specifically, the present invention pertains to a process wherein a sheet of alloy powders is applied to a surface of a substrate of an iron-based material and sintered on the body to form a sintered layer.

2. Description of Prior Art

Hithertofore, it has been proposed for example by Japanese patent laid open application 52-65111 to provide a sintered layer on a metal substrate by applying a sheet of alloy powders on the substrate and heating it to a sintering temperature. In this process, alloy powders in the alloy sheet are at least partly liquefied and, after solidification, provide a firm bond of the sintered layer to the substrate.

It should however be noted that, in this conventional process, problems are encountered where the substrate is of an iron-based material containing carbon. In case where the substrate is of an iron-based material containing carbon such as graphite, the carbon is diffused through the liquefied part into the sheet causing an increase in the part of liquid phase. As the results, there is produced voids or other defects at the junction between the substrate and the sintered layer. Further, the sintered layer becomes carbon rich and the eutectic point is decreased so that the sintering temperature is accordingly decreased producing a coarse matrix structure. This will cause decreases in wear-resistant property and strength of the sintered layer. It should also be noted that an increase in the liquid phase have an adverse effect on the solidity of the alloy powder sheet so that the alloy powder sheets may be deformed during the sintering process.

SUMMARY OF THE INVENTION

It is therefore an object of the present invention to provide a process for forming a sintered layer on a substrate of an iron-based, carbon-containing material, wherein carbon diffusion into the sintered layer can be effectively prevented.

Another object of the present invention is to provide a process for forming a sintered alloy layer on a substrate of an iron-based, carbon-containing material by using a sheet of alloy powders which is applied to the substrate prior to heating to a sintering temperature, wherein a blocking layer is provided between the substrate and the alloy powder sheet for preventing diffusion of carbon into the alloy powder sheet.

A further object of the present invention is to provide a process for forming a sintered alloy layer on a substrate of an iron-based, carbon-containing material by using a sheet of alloy powders which is applied to the substrate prior to heating to a sintering temperature, wherein a layer is provided beneath the alloy powder sheet for suppressing diffusion of carbon into the alloy powder sheet in sintering process.

According to the generic aspect of the present invention, the above and other objects can be accomplished by a process for forming a sintered layer on a substrate of iron-based, carbon-containing material, including steps of providing a sheet of alloy powders, applying said sheet on said substrate and heating said sheet to a sintering temperature to produce a sintered layer by said sheet, the alloy powders in said sheet producing a liquid phase during the heating step so that the sintered layer is firmly fitted to the substrate, the improvement comprising a step of providing a lamina beneath the sheet prior to the heating step, said lamina being able to suppress diffusion of carbon from said substrate to said sheet during the heating step.

In one aspect of the present invention, the lamina is provided by a layer of metal plating or a layer of metal oxide formed on the substrate. Alternatively, an intermediate sheet may be provided by a material which produces substantially no or little liquid phase under the sintering temperature and located between the alloy powder sheet and the substrate prior to the heating step. In another aspect, the substrate surface may be subjected to a decarbonization process to form a decarbonized lamina or the substrate may be formed with a lamina wherein the carbon content is deactivated by being combined with iron to produced iron carbides.

The above and other objects and features of the present invention will become apparent from the following descriptions taking reference to the accompanying drawings.

DESCRIPTION OF THE PREFERRED EMBODIMENTS

Figure 1A:
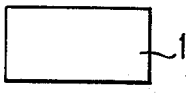
FIGS. 1 (*a*), (*b*), (*c*) and (*d*) show steps of a sintering process in accordance with one embodiment of the present invention.
Figure 1B:
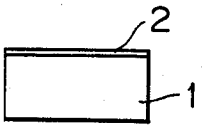
Figure 1C:
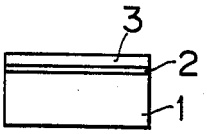
Figure 1D:
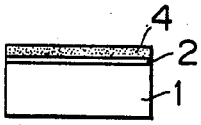

Referring to the drawings, particularly to FIG. 1 (*a*), there is shown a substrate 1 which is made of a blake graphite cast iron or a particulate graphite cast iron containing eutectic-alloy-forming elements such as C, P, Mo and B. The substrate 1 is formed with a layer 2 of metal plating such as Cu, Ni or Cr plating as shown in FIG. 1 (*b*).

Then, as shown in FIG. 1 (*c*), an alloy powder sheet 3 is adhered to the metal plating layer 2 of the substrate 1. The alloy powder sheet 3 is made of powders finer than 150 mesh of wear resistant alloy containing in weight 0.5 to 2.5% of P, 1.5 to 4.5% of C, 2.5 to 5.5% of Mo, less than 10% of Cr, and the balance of Fe, the alloy powders being mixed in 85 to 97 volume % with 15 to 3 volume % of a solution of acrylic resin. The mixture of the alloy powders and the resin solution is kneeded and rolled into a sheet of a predetermined thickness and applied to the substrate as described above. The alloy powder sheet has an adhesive property to the substrate even under a temperature lower than 400° C.

The substrate 1 which is applied with the alloy powder sheet 3 on the metal plating layer 2 is then heated to a temperature above the eutectic point which is approximately 950° C. Under the temperature, the materials at the interfaces between the substrate 1 and the metal plating layer 2 and between the metal plating layer 2 and the alloy powder sheet 3 are partly liquefied and the alloy powder sheet 3 is sintered to form a hard sintered layer 4 which is adhered to the substrate 1 through the metal plating layer 2 as shown is FIG. 1 (*d*).

During the sintering process, the metal plating layer 2 functions to block the carbon content in the substrate contained in the form of graphite from diffusing into the alloy powder sheet 3. It is therefore possible to prevent the surface portion of the substrate from being molten to an extent that voids and other defects are produced after cooling. Further, it is also possible to prevent formation of coarse matrix structures in the sintered layer. It should be noted that a similar function can be obtained by a layer of a metal oxide such as $Fe_3O_4$ which may be formed in lieu of the metal plating layer 3 by subjecting the substrate to an oxidation treatment such as heating. It is preferable to carry out the oxidation treatment under a temperature between 300° and 560° C. The temperature above 560° C. has a tendency of producing FeO which is more unstable than $Fe_3O_4$. Further, the lamina of the metal oxide will become excessively thick and weaken the bond between the substrate and the sintered layer. Under a temperature less than 300° C., excessive time is consumed to produce the iron oxide so that the process becomes uneconomical. The iron oxide layer of a desired thickness can be obtained by heating the substrate at 560° C. for approximately 1 hour and at 300° C. for approximately 4 hours. In lieu of the layer of the iron oxide, a nitrided layer may be formed for obtaining a similar function. The metal plating layer may be substituted by a thin film of a metal.

The process shown in FIG. 1 is advantageous in that the thickness of the diffusion blocking layer 2 can be appropriately controlled in accordance with the carbon content of the substrate.

Figure 2A:
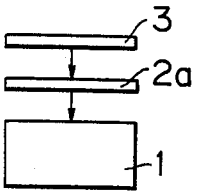
FIGS. 2 (*a*) and (*b*) show steps of a sintering process in accordance with another embodiment of the present invention.
Figure 2B:
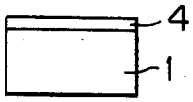

Referring to FIG. 2 (*a*), it will be noted that an intermediate sheet 2*a* is provided between the substrate 1 and the alloy powder sheet 3. The intermediate sheet 2*a* is formed by powders finer than 80 mesh of an alloy containing at least one of C, P, B, Mo and Mn in an amount less than 0.5% in weight and the balance substantially of Fe, the alloy powders being mixed in 85 to 97 volume % with 15 to 3 volume % of solution of acrylic resin. The mixture is kneaded and rolled into a sheet of 0.5 to 4.0 mm thick and 4.0 g/cm$^3$ in density. With the powder size greater than 80 mesh, there will be an increased tendency that voids and other defects are produced. The alloy powders may contain less than 10% in weight of Ni, Cu or Co which will suppress continuous carbides in the intermediate sheet during the sintering process.

The alloy powder sheet 3 is applied to the substrate 1 with the intermediate sheet 2*a* intervened between the substrate 1 and the alloy powder sheet 3. Thereafter, the sintering process is carried out as in the previous embodiment. The intermediate sheet 2*a* produces substantially no or very little liquid phase during the sintering process so that it is possible to block the diffusion of carbon from the substrate to the alloy powder sheet 3. The intermediate sheet 2*a* produces an alloy through the sintering process so that it provides a strong bonding power between the substrate 1 and the sintered layer formed by the alloy powder sheet 3. The intermediate sheet 2*a* is convenient to use because it can be attached to the substrate with an adhesive which is of the same type as the adhesive used for attaching the alloy powder sheet.

Figure 3A:
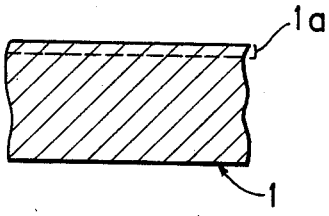
FIGS. 3 (*a*), (*b*) and (*c*) show steps of a further embodiment.
Figure 3B:
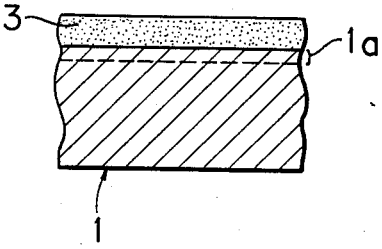
Figure 3C:
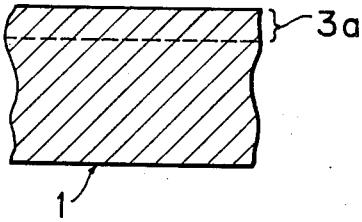

Referring now to FIG. 3, the substrate 1 is at first subjected to a decarbonizing treatment to produce a decarbonized lamina 1*a* on a surface of the substrate 1 as shown in FIG. 3(*a*). Then, the previously described alloy powder sheet 3 is attached to the surface of the substrate 1 wherein the decarbonized lamina 1*a* is formed as shown in FIG. 3(*b*). Thereafter, the substrate 1 having the alloy powder sheet 3 attached thereto is heated to a sintering temperature to form a sintered layer 3*a* on the substrate 1 as shown in FIG. 3(*c*). Instead of the decarbonization, a treatment may be carried out to convert the graphite into a carbide. Such treatment may be carried out by injecting laser beams or electron beams to the surface of the substrate to promote chemical reaction of the graphite with the iron.

EXAMPLES

Example 1

A substrate was prepared from a flaky graphite cast iron containing in weight 3.5% of C, 4.0% of Si, 0.5% of Mn, 0.05% of P, 0.06% of S and the balance substantially of Fe. The cast iron was machined to a piece of 30 mm long, 50 mm wide and 20 mm high to prepare the substrate.

There were prepared powders finer than 150 mesh of ternary eutectic alloy containing in weight 5.5% of Mo, 2.5% of Cr, 2.4% of P, 3.6% of C and the balance substantially of Fe. There were also prepared powders finer than 150 mesh of corrosion resistant steel meeting the Japanese Industrial Standard (JIS) SUS 410. The alloy powders were mixed in 50 weight % with 50 weight % of the powders of the corrosion resistant steel. The mixture was then mixed in 96 volume % with 4 volume % of acrylic binder and kneaded by adding acetone. The kneaded mixture was then rolled into a sheet of 4.8 g/cm$^2$ in density and 2 mm in thickness. The sheet was then cut into a piece of 10 mm square.

The substrate piece was subjected to a decarbonizing treatment by heating it in a furnace to 800° C. for 3 hours and then cooling in air. Thereafter, the alloy sheet piece was attached to the substrate piece through the acrylic binder and heated in a hydrogen atmosphere to 300° C. at a heating rate of 150° C./min. and maintained at the temperature for 60 minutes. Then, the alloy sheet piece attached to the substrate piece is further heated to 1090° C. at a heating rate of 150° C./min. and maintained at the temperature for 20 minutes to form a sintered layer on the substrate.

The substrate piece and the sintered layer formed thereon have been microscopically inspected and it has been confirmed that there is no defect in the structure of the substrate and coarse grain particles are not produced in the sintered layer.

EXAMPLE 2

A substrate member was prepared from a granular graphite cast iron containing in weight 3.6% of C, 2.5% of Si, 0.34% of Mn, 0.017% of P, 0.013% of S, 0.043% of Mg and the balance substantially of Fe. An alloy powder sheet was prepared by mixing powders finer than 150 mesh of wear resistant alloy containing in weight 2.2% of C, 1.2% of P, 4.5% of Mo, 8.5% of Cr and the balance substantially of Fe in 95 volume % with 5 volume % of toluene solution of acrylic resin. The mixture was kneaded and rolled into a sheet of 1.5 mm thick. The sheet was then cut into a circular piece having a diameter of 30 mm. An intermediate sheet was prepared from powders finer than 80 mesh of an alloy containing in weight 0.8% of C, 0.5% of P, 1.0% of Mo and the balance substantially of Fe. The powders were mixed in 97 volume % with 3 volume % of toluene solution of acrylic resin and kneaded. Then, the mixture was rolled into a sheet of 0.5 mm thick and 42 g/cm$^3$ in density. The sheet was then cut into a circular piece having a diameter of 25.5 mm.

The piece of the intermediate sheet was attached to the substrate member and the piece of the alloy powder sheet was attached to the piece of the intermediate sheet.

Figure 4:
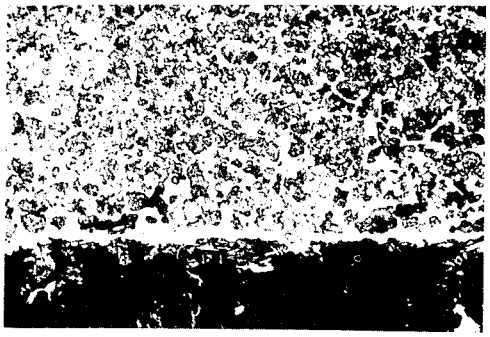
FIG. 4 is a microscopic picture showing a structure of the sintered layer produced by a process in accordance with the present invention.

The test piece was then heated at a heating rate of 10° C./min. to 300° C. and maintained at the temperature for 60 minutes. Thereafter, the test piece was further heated at a heating rate of 10° C./min. to 1080° C. and maintained at the temperature for 20 minutes. In FIG. 4, there is shown a microscopic picture of a section of the test piece. It will be noted that there is formed a sintered layer containing uniformly distributed carbides. It will further be noted that the junction between the sintered layer and the substrate is free from defects.

Comparative Test

Figure 5:
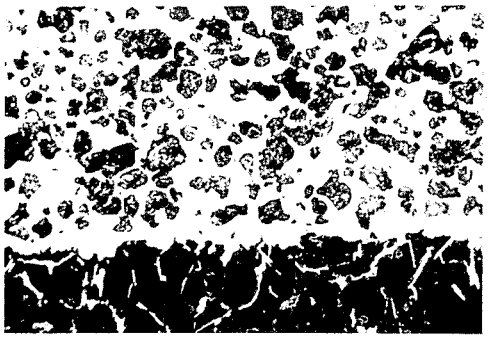
FIG. 5 PRIOR ART
FIG. 5 is a picture showing the sintered layer in accordance with a conventional process.

A test similar to Example 2 was carried out without using the intermediate sheet. FIG. 5 shows a microscopic structure obtained by the test. It will be noted that the sintered layer includes coarse matrix structure.

The invention has thus been shown and described with reference to specific examples, however, it should be noted that the invention is in no way limited to the details of the examples but changes and modifications may be made without departing from the scope of the appended claims.

We claim:

1. A process for forming a sintered layer on a substrate of iron-based, carbon-containing material, including steps of providing a sheet of powders of an Fe-M-C type alloy, M being at least one of Mo, Cr, B and P, applying said sheet on said substrate and heating said sheet to a sintering temperature to produce a sintered layer by said sheet, said sintered layer containing a carbide produced in the heating step, the alloy powders in said sheet producing a liquid phase during the heating step so that the sintered layer is firmly fitted to the substrate, the improvement comprising a step of providing a lamina beneath the sheet prior to the heating step, said lamina being formed by injecting active beams to a surface of the substrate to convert carbon into a carbide and able to suppress diffusion of carbon from said substrate to said sheet during the heating step.

2. A process in accordance with claim 1 in which said lamina is an intermediate sheet which produces substantially no liquid phase under the sintering temperature.

3. A process in accordance with claim 6 in which said intermediate sheet is made of powders of alloy containing at least one of C, P, B, Mo and Mn in an amount less than 0.5 weight %, the balance being substantially of Fe, the powders being mixed with a solution of resin.

4. A process in accordance with claim 3 in which said powders for the intermediate sheet are finer than 80 mesh.

5. A process in accordance with claim 3 in which said powders for the intermediate sheet contain at least one of Ni, Cu and Co in an amount less than 10% in weight.

6. A process for forming a sintered layer on a substrate of iron-based, carbon-containing material, including steps of providing a sheet of powders of an Fe-M-C type alloy, M being at least one of Mo, Cr, B and P, applying said sheet on said substrate and heating said sheet to a sintering temperature to produce a sintered layer by said sheet, said sintered layer containing a carbide produced in the heating step, the alloy powders in said sheet producing a liquid phase during the heating step so that the sintered layer is firmly fitted to the substrate, the improvement comprising a step of providing a lamina beneath the sheet prior to the heating step, said lamina being an intermediate sheet which produces substantially no liquid phase under the sintering temperature and able to suppress diffusion of carbon from said substrate to said sheet during the heating step.

* * * * *